United States Patent [19]

Wideman

[11] Patent Number: 4,573,331

[45] Date of Patent: Mar. 4, 1986

[54] THUMB RING

[76] Inventor: Merle L. Wideman, P.O. Box 5644, Dhahran, Saudi Arabia

[21] Appl. No.: 543,928

[22] Filed: Oct. 20, 1983

[51] Int. Cl.[4] ..... A44C 9/00

[52] U.S. Cl. ..... 63/15; D11/28

[58] Field of Search ..... 63/15; D11/27, 28

[56] References Cited

U.S. PATENT DOCUMENTS

| | | | |
|---|---|---|---|
| D. 87,164 | 6/1932 | McCarty | 63/15 UX |
| D. 133,402 | 8/1942 | Boucher | D11/27 |
| D. 151,789 | 11/1948 | Shapiro | 63/15 UX |
| D. 183,639 | 9/1958 | Touraine | D11/28 |
| D. 193,600 | 9/1962 | Kravitz | D11/27 |
| D. 243,359 | 2/1977 | Nevrous | 63/15.5 X |
| 2,016,679 | 10/1935 | Mayer | 63/2 X |

*Primary Examiner*—F. Barry Shay

[57] ABSTRACT

A thumb ring construction for use as ornamentation on a hand including a support base member on which a decorative gem can be disposed and a ring shank attached to the support base where the ring shank has undulations with respect to a vertical transverse plane. The ring shank and base member define an opening and a central axis through the center of the opening. The mid or side portions of the ring shank are inclined relative to the central axis to enhance the fit of the ring shank to a thumb and to provide rotational stability of the ring when worn on a thumb.

5 Claims, 6 Drawing Figures

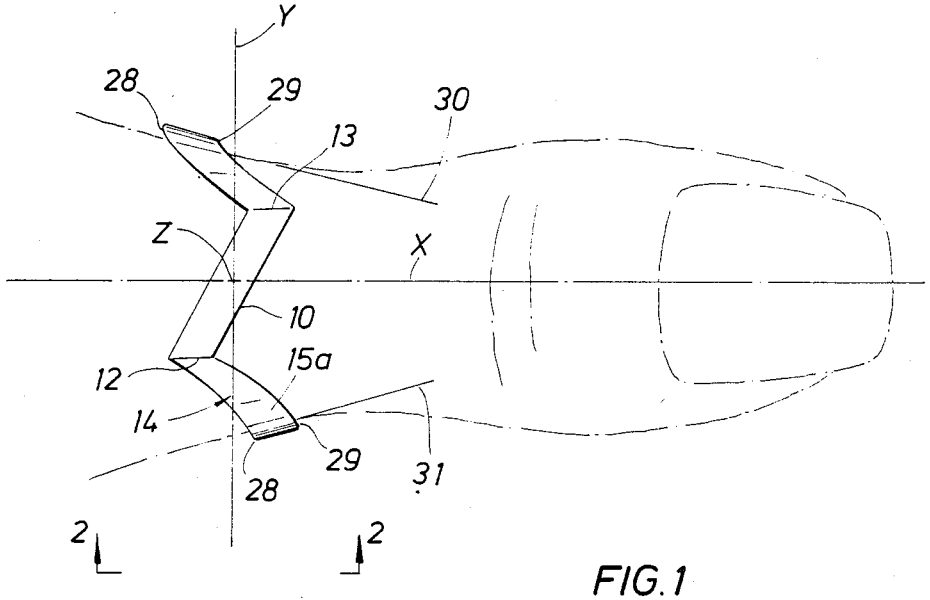
FIG. 1
FIG. 2
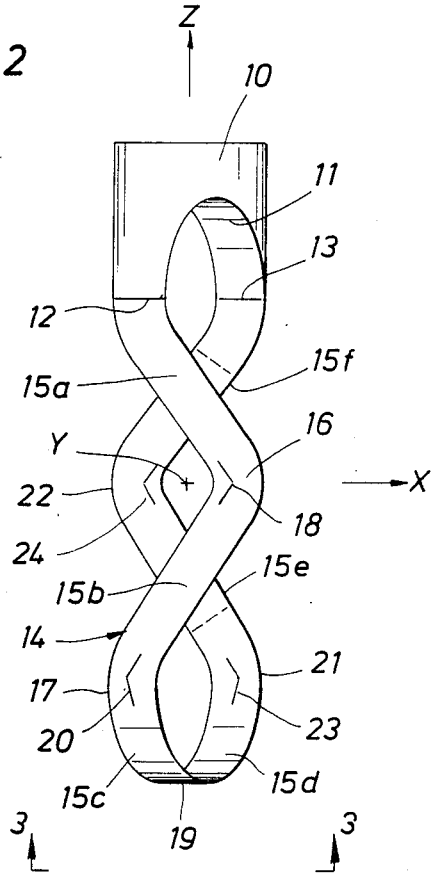
FIG. 3
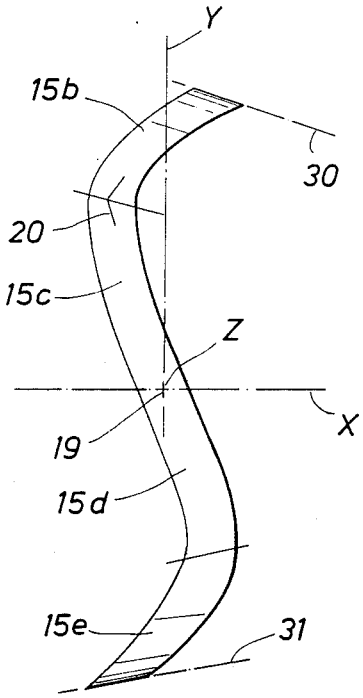

THUMB RING

PRIOR APPLICATION

The subject matter of this Application is related to a co-pending pending Application Ser. No. 345,562, filed Feb. 4, 1982.

FIELD OF THE INVENTION

This invention relates to thumb rings and more particularly, to construction of thumb rings so as to provide positional stability of a ring on a thumb.

Rings are as old as, perhaps, mankind and have been worn on the fingers and thumb as ornamental objects as an accepted fashionable practice. The principal focus of a ring is upon the jewel or gem and its setting, or the ornamental design of the ring band and there has been little attention paid to the need for providing stability of a ring with respect to rotation on a thumb. Thus, it is a common feature and failing of rings, that a ring tends to rotate about the axis of the thumb while in use and fails to retain positional stability during use. Thus, rings are sometimes cumbersome and awkward when worn during working and restrict the motion and use of the hand. Also, the lack of positional stability detracts from the ornamental features of the jewel in its intended fashion and makes it less desirable.

DESCRIPTION OF THE PRIOR ART

The pertinent prior art known is as follows:

(1) U.S. Pat. No. 1,950,526. This patent relates to a ring with two criss crossed bands which provide an area of enlargement so that the tendency of rotation is reduced.

(2) U.S. Pat. No. 2,073,228. This patent relates to a finger ring in which the ring is designed to follow the contour of a finger at its base by use of a warped shank.

(3) The Levine design U.S. Pat. No. 71,605 shows a base member with a ring shank. The ring shank is attached at opposite connection points on the base. The shank extends from the connection points in the same direction to an apparent horizontal plane mid point and then reverses to a bottom point which is directly below the connecting points. Thus, the shank is located entirely to one side of the base member and there is no illustration relative to a thumb.

(4) The McCarty design U.S. Pat. No. 87,164 is for an ornamental finger ring which has a circular configuration (FIG. 2) and has a uniform band or shank width and no base member. The band appears to have four segments in a circle and respectively offset at 90° with respect to one another.

(5) The Belleza U.S. Pat. No. 184,320 relates to the curvature of a ring shank for comfort and for placing the ornament in far enough in back of the second joint of the finger so as to not interfere with the second joint. The rearward projecting portion rests in the bend of the third joint on the inside of the hand. The ring shank extends in the same direction from the connection point at the ornament.

(6) The Mayer U.S. Pat. No. 2,106,679 relates to interlocking complementary ring elements which interfit. The concept is applicable to bracelets, brooches, pendants, clusters, earrings and similar articles. In FIG. 1, the ring has ends (FIG. 2) and intermediate elements (FIG. 5). The ends preferably have a plane edge and an irregular saw tooth edge. The intermediate elements have saw tooth surfaces. FIG. 7 shows the cross-section of the ring to be circular.

(7) The Shields U.S. Pat. No. 2,084,008 relates to shaping a ring shank to fit a ring finger. As shown in FIG. 3 of the patent, the webbing between the fingers is at different distances or lengths from the tip of the ring finger. The shank of a ring is offset at difference distances from an axis to accomodate the difference in finger webbing so that the setting box is parallel to the axis of the finger. The shank is also offset so that the lower portion of the shank lies in the crease in the juncture of the finger with the palm of the hand. The cross-section of the shank (FIG. 2) is made of two circular segments of unequal radii.

(8) The Nevrous Design U.S. Pat. No. 243,359 illustrates a circular shaped ring or bracelet with an undulating curvature confined between two vertical planes.

(9) Mobell Design U.S. Pat. No. 244,674 which illustrates a circular shaped ring with separate or split shank members.

(10) Lavin Design U.S. Pat. No. 252,802 which illustrates a circular shaped ring shank in two parts.

(11) Ambrose U.S. Pat. No. 4,199,962 which illustrates a ring with a plurality of finger passages.

The foregoing prior art represents efforts at preventing ring rotation which are substantially different from the concepts of the present invention.

SUMMARY OF THE PRESENT INVENTION

The present invention involves a ring for use on a thumb in which an ornamental gem can be set on a base support member which is attached to a ring shank. The ring shank has a relatively flat interior surface, i.e., generally straight in the direction through the ring opening and the shank has undulations about a vertical plane transverse to the longitudinal axis extending through the opening of the shank. The undulations of the shank are such that the shank, at a horizontal plane midway of the opening of the shank, is disposed to either side of the vertical plane and the interior surface is inclined relative to a vertical longitudinal plane to provide a contact surface which conforms to the surface inclinations of a thumb. The direction of inclination of the interior surfaces is on a taper along the side portions of the shank.

Accordingly, it is an object of the present invention to provide a new and improved ring which, when positioned on a thumb, will hold its rotational position on the thumb.

BRIEF DESCRIPTION OF THE DRAWINGS

The present invention may best be understood when taken in conjunction with the accompanying drawings in which:

FIG. 1 illustrates a top view of a thumb ring of the present invention disposed upon a left hand thumb illustrated in dashed lines;

FIG. 2 is a view from the side of the thumb ring shown in FIG. 1 taken along line 2—2 of FIG. 1;

FIG. 3 is a view taken along line 3—3 of FIG. 2;

DESCRIPTION OF PREFERRED EMBODIMENT

Figure 4:
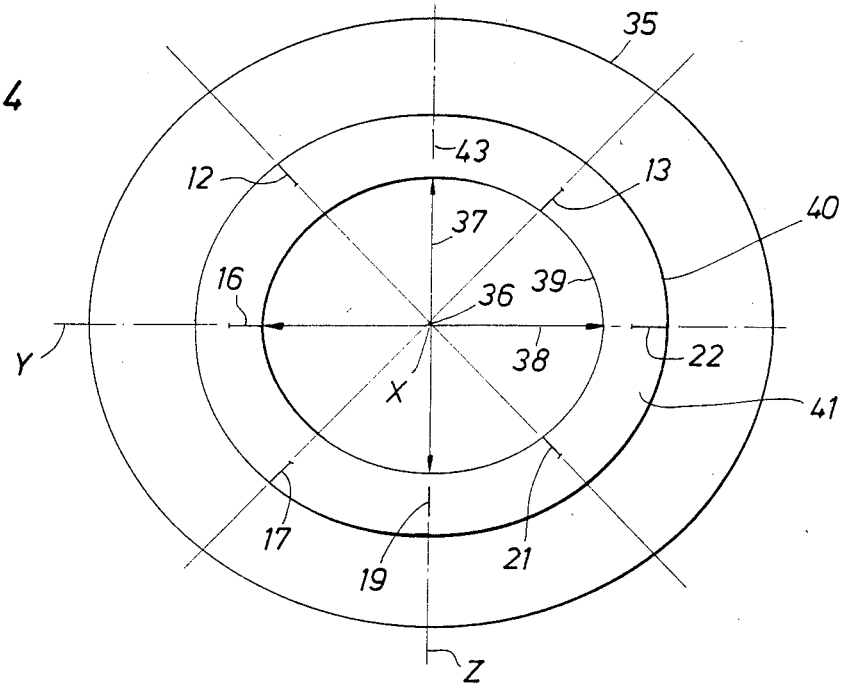
FIG. 4 is a plan view of an eliptically shaped, tapered cone.

The general configuration of a typical thumb is such that, from a top view, it has an outward curvature from the thumbnail to the knuckle and then a concave curvature between the knuckle and the connected hand portion. When viewed from the side, a typical thumb has a generally parallel configuration with a slight inward tapered inclination from the hand toward the nail. In cross-section, the thumb has a sort of flattened oval or eliptical configuration with the transverse dimension being somewhat greater than the vertical dimension.

Most rings have a circular configuration and ring size measurements are made with respect to the circular configuration necessary for passage over the knuckle of a finger or thumb. The fingers, in contradistinction to the thumb, are more circular in cross-section and thus are more susceptible to accommodating a uniform cross-sectional opening in a ring.

For purposes of description of this invention, certain terminology as noted and used hereafter will be adopted for explanation purposes.

As illustrated in the drawings, the thumb ring of the present invention includes an upper support member or base 10 on which a gem can be set or mounted in a gem setting base. The base portion 10 can be configured to receive various sizes of gems. With the vertical center of support base member 10 as the center line of dimensioning with respect to the ring (the "Z" axis, FIG. 1), the longitudinal vertical plane "XZ" through the base member 10 generally coincides with a longitudinal vertical plane of a thumb when the ring is on a thumb. A transverse vertical plane "YZ" intersects the base member 10. The center of the support member and shank which define the ring opening is located on an "X" axis in the horizontal plane "XY".

FIG. 2 is a side view taken along line 2—2 of FIG. 1. The support member 10, as shown in FIGS. 1 and 2 extends transversely with respect to the "X" axis and at an angle with respect to the "Y" axis. The geometric shape of the support member can by any desired configuration which has an interior curved and tapered surface 11 and which has a shank connection location 12 positioned to one side of the "Y" axis and an opposite shank connection location 13 positioned to the other side of the "Y" axis.

The connection locations illustrated by the lines 12 and 13 are at either extremity of a ring shank 14 which extends between the locations 12 and 13 and which has an eliptical and tapered inner surface with respect to the "X" axis and has undulations with respect to the "YZ" planes (See FIGS. 2 & 3). Because the configuration of the shank does not illustrate well in plane view, spacial and expanded plane views will be utilized in the description and the illustrations are with respect to the inner surface of the shank.

The width and thickness of the shank 14 can be as desired, the present invention being concerned with the undulations of the shank and the inner surface configuration.

As shown in FIGS. 1, 2 and 3, the shank 14, between the connection location 12 and the "XY" plane has a shank portion 15*a* which extends from the location 12 to the left of the "YZ" plane (FIG. 2) to a location 16 to the right of the "YZ" plane. From the location 16, a shank portion 15*b* extends to a lower location 17 to the left of the "YZ" plane. The shank portions 15*a* and 15*b* form a first undulation angle 18. From the location 17, a bottom shank portion 15*c* extends to a bottom location 19 which is on the "YZ" plane. The shank portions 15*b* and 15*c* form a second undulation angle 20 which is reversed with respect to the undulation angle 18. From the bottom location 19, a bottom shank portion 15*d* extends to a lower location 21 to the right of the "YZ" plane. The bottom shank portions 15*c* and 15*d* thus cross from one location 17 on one side to the "YZ" to another location 21 and the other side of the "YZ" plane and intersect the "Z" axis in the "YZ" plane.

From the location 21, a shank portion 15*e* extends to a location 22 which is to the left of the "YZ" plane. The shank portions 15*d* and 15*e* form a third undulation angle 23 which is reversed with respect to the second undulation angle 20. From the location 22, a shank portion 15*f* extends to the connection location 13 and crosses to the right side of the "YZ" plane. The shank portions 15*e* and 15*f* form a fourth undulation angle 24 which is reversed with respect to the undulation angle 23.

As is apparent from the description and drawings, the shank member 14 undulates with respect to the vertical and transverse plane "YZ" and the undulations extend between a location to either side of the support member 10 with respect to the "YZ" plane with the lower shank portions 15*c* and 15*d* passing through the vertical "Z" axis at 19. The shank undulations are such that the shank is attached to the ring base on opposite sides of the "YZ" plane.

Figure 5:
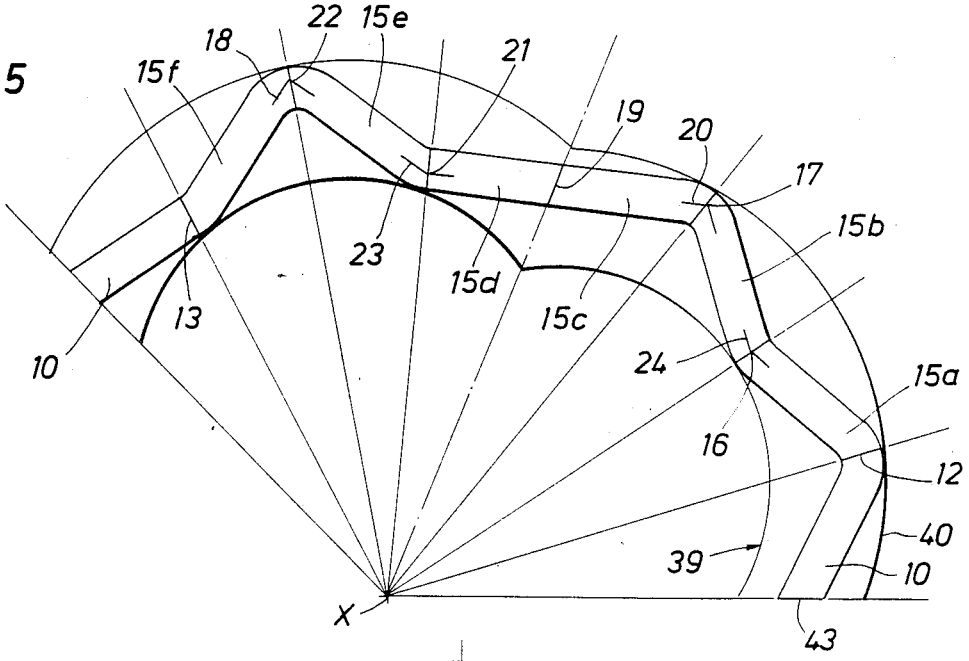
FIG. 5 is a planar view of the eliptically shaped tapered cone of FIG. 4 and illustrating the surface configuration of the ring shank.

In one embodiment, the tapered inner surface extends around the entire ring opening defined by the base member and the shank. Referring now to FIGS. 4 and 5, in FIG. 4 an exaggerated taper is shown for purposes of illustration. In FIG. 4, the number 35 illustrates an eliptically shaped base which is tapered to an apex 36 with a minor axis along the "Z" axis and a major axis along the "Y" axis. The axes 37 and 38 are minor and major axis for a first eliptical FIG. 39 parallel to the "YZ" plane. A second eliptical FIG. 40 parallel to the "YZ" plane has larger minor and major axis so as to define a tapered surface 41 which lies between FIGS. 39 and 40. On the tapered eliptical surface 41, the line 12 corresponds to the inner surface of the shank 14 at the location 12; the line 16 corresponds to the inner surface of the shank 14 at the location 16; the line 17 corresponds to the inner surface of the shank 14 at the location 17; the line 19 corresponds to the inner surface of the shank 14 at the location 19; the line 21 corresponds to the inner surface of the shank 14 at the location 21; the line 22 corresponds to the inner surface of the shank 14 at the location 22; the line 13 corresponds to the inner surface of the shank 14 at the location 13; and the line 43 corresponds to the inner surface of the base member 10 at a location 43 at the exact top of the ring opening.

Thus it can be seen that the ring shank 14 is tapered and undulates. As shown in plan view in FIG. 5 the undulations of a shank lie on a tapered surface between parallel planes where the undulations are confined between elipses on the parallel planes. It will also be apparent that the surface locations 16 and 22 are displaced from one another along the X-axis so that, in effect, an enlarged opening is presented along an angle with respect to the X-axis. This permits the ring to be easily passed over the thumb knuckle in an angular fashion and straightened on the thumb after passing over the knuckles to bring the locations 16 and 22 into contact with the surface of the thumb.

As illustrated in FIGS. 1 and by lines 30 and 31, the interior surface of the mid-shank portions are angularly inclined or tapered with respect to the vertical plane "XZ" in a conical direction. As shown in FIG. 1, the inclinations of the shank portions lying in the "XY" plane extend from a rearward edge surface 28 to a forward edge surface 29. Thus, the rearward edge 28 of the shank is farther away from the "X" axis than a corresponding portion of a forward edge 29. The inclination of the shank portions is generally proportioned to general tapered inclination at the transverse cross-section of a thumb where the shank contacts the thumb. The general tapered configuration is essential on the "XY" plane.

As will be appreciated, the ring shank 14 has four basic undulation angles 18, 20, 23 and 24. Each angle is reversed with respect to an adjacent angle. The degree as well as the location of the start of the angle may vary but there are always a minimum of four undulation angles.

Figure 6:
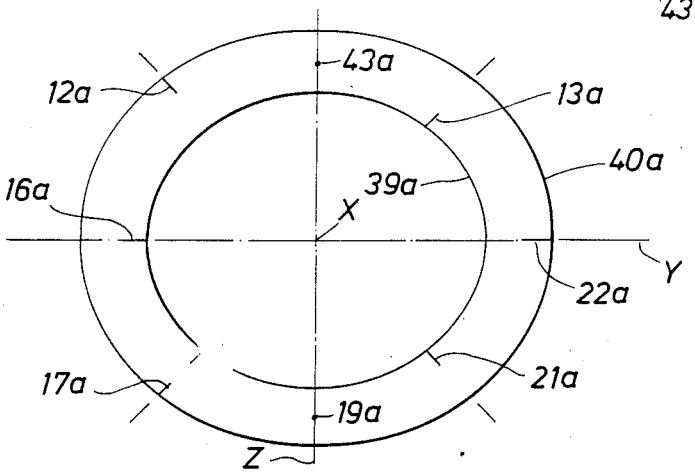
FIG. 6 is a plan view of an eliptically shaped cone which is used to explain the configuration of the interior surface of an embodiment of the ring shank.

Referring now to FIG. 6, the oval planes 39*a* and 40*a* define a surface of a non-circular conic body, which extends between them. Lines 43*a* and 19*a* represent locations on the body corresponding to locations on an inner surface of a ring shank. In the ring shank the cone surface would be altered so that lines 43*a* and 19*a* on the ring shank would be parallel to the X-axis. The lines 16*a* and 22*a* on the ring shank would remain on a taper or inclination with respect to the X-axis, just as shown in FIG. 6. Between the surface lines 43*a* to surface lines 16*a* and 22*a* the interior surface of the ring shank changes inclination from parallel to the X-axis at 43*a* to a diverging inclination with respect to the X-axis at 16*a* and 22*a*. Similarly from 16*a* and 22*a* to the location 19*a* the interior surface changes from the diverging inclination with respect to the X-axis to a parallel position with respect to the X-axis. The degree of inclination is suitable to match the inclination of the surface of a thumb.

I claim:

1. A ring for use on a thumb member comprising:

a base member, said base member having a vertical longitudinal plane such that when the base member is disposed on the back of a thumb member on which the ring is worn there is a general coincidence of said base member vertical longitudinal plane with a vertical longitudinal plane which extends through and bisects the thumb member;

shank means attached to said base member on opposite sides of said vertical longitudinal plane, said shank means and said base member having a generally flat interior surface defining an opening for receiving a thumb member where said opening has a central axis;

said shank means having its flat interior surface tapered with respect to the central axis for the opening, said shank means having curvatures with respect to a vertical, transverse plane for defining four successive undulation angles where each angle is reversed with respect to an adjacent angle, said undulation angles and said tapered flat interior surface making up means whereby an interior contact surface is provided which conforms to the surface inclinations of the thumb and tends to maintain a non-rotatable relation between the ring and thumb.

2. The ring as defined in claim 1 wherein said opening is eliptical.

3. A ring for use on a thumb member comprising:

a base member suitable for receiving an ornamental gem, said base member having a vertical longitudinal plane such that when the base member is disposed on the back of a thumb member on which the ring is worn there is a general coincidence of said base member vertical longitudinal plane with a vertical longitudinal plane which extends through and bisects the thumb member;

ring shank means attached to said base member on opposite sides of said vertical longitudinal plane, said shank means and said base member defining an opening for receiving a thumb member, said shank means and said base member having generally flat interior surfaces for contact with the surface of a thumb member;

said shank means having middle shank portions where said flat interior surfaces with respect to their extension in the same direction of the opening through the ring, have inclinations toward each other and toward said vertical longitudinal plane, said middle shank portions intersecting a horizontal transverse plane disposed midway of the vertical axis of said opening, said inclinations of said middle portions being such that the middle shank portions bring the flat interior surface of said shank means into contact with the surface of a thumb member; and said shank means having undulations defining at least four undulation angles, said undulation angles being located offset with respect to a transverse vertical plane which intersects said vertical longitudinal plane and the vertical axis of said opening having a smaller dimension than the horizontal axis of said opening to define an out-of-round opening shaped to enhance the contact of the shank means with a thumb surface, said undulation angles and said inclinations making up means whereby an interior contact surface is provided which conforms to the surface inclinations of the thumb and tends to maintain a non-rotational relation between the ring and thumb.

4. The ring as set forth in claim 3 wherein said shank means has symmetrical configurations about a central longitudinal axis through said opening.

5. A ring for use on a thumb member comprising:

a horizontal base member;

said base member having a vertical longitudinal plane such that when the base member is disposed on the back of a thumb member on which the ring is worn there is a general coincidence of said base member vertical longitudinal plane with a vertical longitudinal plane which extends through and bisects the thumb member;

a ring shank attached to said base member on opposite sides of said vertical longitudinal plane, and said ring shank and said base member having generally flat interior surfaces defining a ring opening for contact with the surface of a thumb member;

said ring shank having a curvature which, when viewed from one side of the ring, has a generally curved configuration defining a first undulation angle and, when viewed from the other side of the ring, has a generally curved configuration which defines a second undulation angle which is reversed with respect to the said one first undulation angle;

said ring shank when viewed from the bottom having a curvature defining third and fourth undulation angles, said third undulation angle being reversed with respect to said first undulation angle and said fourth undulation angle being reversed with respect to said third undulation angle; and said ring shank and said base member having the flat interior surfaces defining the ring opening disposed at an inclination or tapered relationship with respect to an axis through the opening of said ring shank and said base member, said undulation angles and said inclined or tapered flat interior surfaces making up means whereby an interior contact surface is provided which conforms to the surface inclinations of the thumb and tends to maintain a non-rotatable relation between the ring and thumb.

* * * * *